US006406803B1

(12) United States Patent
Abe et al.

(10) Patent No.: US 6,406,803 B1
(45) Date of Patent: Jun. 18, 2002

(54) ELECTROLUMINESCENT DEVICE AND METHOD FOR PRODUCING THE SAME

(75) Inventors: Hidetoshi Abe, Tendo; Yoshinori Araki, Sagae, both of (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/424,110

(22) PCT Filed: Mar. 27, 1998

(86) PCT No.: PCT/US98/06119

§ 371 (c)(1),
(2), (4) Date: Jan. 27, 2000

(87) PCT Pub. No.: WO98/53645

PCT Pub. Date: Nov. 26, 1998

(30) Foreign Application Priority Data

May 19, 1997 (JP) ..... 9-128626

(51) Int. Cl.[7] ..... H05B 33/14

(52) U.S. Cl. ..... 428/690; 428/704; 428/917; 428/327; 428/323; 313/498; 313/502; 313/503; 313/506; 313/509; 313/512

(58) Field of Search ..... 428/690, 917, 428/704, 327, 323; 313/498, 502, 503, 506, 509, 512

(56) References Cited

U.S. PATENT DOCUMENTS 4,413,090 A 11/1983 Shoji et al. ..... 525/59
5,019,748 A * 5/1991 Appelberg ..... 315/169.3
5,912,533 A * 6/1999 Lee et al. ..... 313/503

FOREIGN PATENT DOCUMENTS

| | | |
|---|---|---|
| EP | 0 062 351 | 8/1985 |
| EP | 0 323 218 | 7/1989 |
| JP | 84-014878 | 4/1984 |
| JP | 87-059879 | 12/1987 |
| WO | WO 88/04467 | 6/1988 |

OTHER PUBLICATIONS

Richard J. Lewis, Sr., Thirteenth EditionCondensed Chemical Dictionary, Thirteenth Edition, 1997, p. 371.*

* cited by examiner

*Primary Examiner*—Cynthia H. Kelly
*Assistant Examiner*—Ling Xu
(74) *Attorney, Agent, or Firm*—Rudolph P. Hofmann, Jr.

(57) ABSTRACT

An electroluminescent device and a method for making it are disclosed. The device has a transparent substrate, a transparent conductive layer, a luminescent layer comprising luminescent particles and a matrix resin, and a rear electrode, wherein the luminescent layer has a transparent support layer comprising a matrix resin and the insulating layer comprising an insulating material, and a luminescent particle layer consisting essentially of particles which comprise luminescent particle and are embedded in both the support layer and the insulating layer.

16 Claims, 1 Drawing Sheet

ELECTROLUMINESCENT DEVICE AND METHOD FOR PRODUCING THE SAME

FIELD OF THE INVENTION

The present invention relates to an electroluminescent device (hereinafter referred to as "EL device") having a luminescent layer comprising luminescent particles and a matrix resin. In particular, the present invention relates to an EL device with high luminance which is based on the concept different from that of conventional "dispersion type luminescent layers".

BACKGROUND OF THE INVENTION

EL devices comprising a so-called "dispersion type luminescent layer" which is formed by dispersing luminescent particles such as fluorescent substances in a matrix resin such as a polymer having a high dielectric constant are known from the following publications:

For example, JP-B-59-14878 discloses an EL device comprising a transparent substrate, a transparent electrode layer, an insulating layer consisting of a vinylidene fluoride base matrix resin, a luminescent layer comprising a vinylidene fluoride base matrix resin and fluorescent particles, the same insulating layer as above, and a rear electrode, which are laminated in this order.

JP-B-62-59879 discloses an EL device comprising a polyester film, an ITO electrode, a luminescent layer comprising a cyanoethylated ethylene-vinyl alcohol copolymer (a matrix resin) and fluorescent particles, and an aluminum foil (a rear electrode), which are laminated in this order.

SUMMARY OF THE INVENTION

However, such the "dispersion type luminescent layers" can hardly increase the luminance, because the luminescent particles having a larger specific gravity than the matrix resin tend to sink in a paint for forming a luminescent layer comprising the luminescent particles dispersed in the matrix resin solution and therefore, it is difficult to disperse the luminescent particles uniformly in the matrix resin in the luminescent layer formed from such the paint.

Furthermore, the dispersibility deteriorates when the amount of the luminescent particles in the paint is increased for increasing the filling rate of luminescent particles in the luminescent layer. Thus, the added amount of the luminescent particles is limited.

In addition, it is relatively difficult to increase a coating thickness of the luminescent layer with a uniform thickness using such the dispersion type paint. Therefore, the number of applications of the paint should be increased to increase the thickness of the luminescent layer for increasing the luminance, the productivity decreases, and it is difficult to produce a sheet-form EL device having a large area.

One object of the present invention is to provide an EL device with an increased filling rate of luminescent particles in a luminescent layer and significantly improved luminance for solving the above problems of the conventional devices.

Another object of the present invention is to provide a method for producing an EL device which can produce a sheet-form EL device having a high luminance and a large area at a high productivity without using the above dispersion type paint.

According to the first aspect (and with reference to FIG. 1.), the present invention provides an electroluminescent device comprising:

a) a transparent substrate (1), b) a transparent conductive layer (2) placed on the back surface of said transparent substrate (1), c) a luminescent layer (8) comprising luminescent particles (7) and a matrix resin and being placed on the back surface of said transparent conductive layer (2), and d) a rear electrode (6) placed on the back surface of said luminescent layer (8), wherein said luminescent layer (8) comprises (c-1) a transparent support layer (3) comprising a matrix resin and being placed on the side of said transparent conductive layer (2), (c-2) an insulating layer (5) comprising an insulating material and being placed on the side of said rear electrode, and (c-3) a luminescent particle layer (4) consisting essentially of particles which comprise luminescent particle (7) and are embedded in both said support layer (3) and said insulating layer (5).

According to the second aspect, the present invention provides a method for producing an electroluminescent device which comprises a transparent substrate (1), a transparent conductive layer (2) placed on the back surface of said transparent substrate (1), a luminescent layer (8) comprising luminescent particles (7) and a matrix resin and being placed on the back surface of said transparent conductive layer (2) and a rear electrode (6) placed on the back surface of said luminescent layer (8), which method comprises the steps of:

i) providing a transparent substrate (1) on one surface of which a transparent conductive layer (2) is laminated, ii) applying a paint for forming a support layer (3) containing a matrix resin on said transparent conductive layer (2), scattering particles containing luminescent particles (7) in a layer state and embedding a part of each particle in said paint prior to solidification of said paint, solidifying said paint and forming a transparent support layer (3) and a luminescent particle layer (4) bonded to said support layer (3), iii) applying a paint for forming an insulating layer (5) comprising an insulating material on said luminescent particle layer (4), solidifying said paint and forming said insulating layer (5) bonded to said luminescent particle layer (4), and iv) laminating a rear electrode (6) on said insulating layer (5).

In the EL device of the present invention, the luminescent particle layer (4) contained in the luminescent layer (8) comprises substantially the particles containing the luminescent particles, and is placed between the support layer (3) and the insulating layer (5) and bonded to the both layers. Therefore, the filling rate of the luminescent particles in the luminescent layer (8) increases, and the luminance increases considerably.

Furthermore, when the EL device is produced by the method of the present invention comprising the steps i) through iv), it is not necessary to use the dispersion type paint of luminescent particles unlike the conventional techniques, and the sheet-form EL device having the high luminance and the large area can be produced at a high productivity.

EMBODIMENTS OF THE INVENTION

Figure 1:
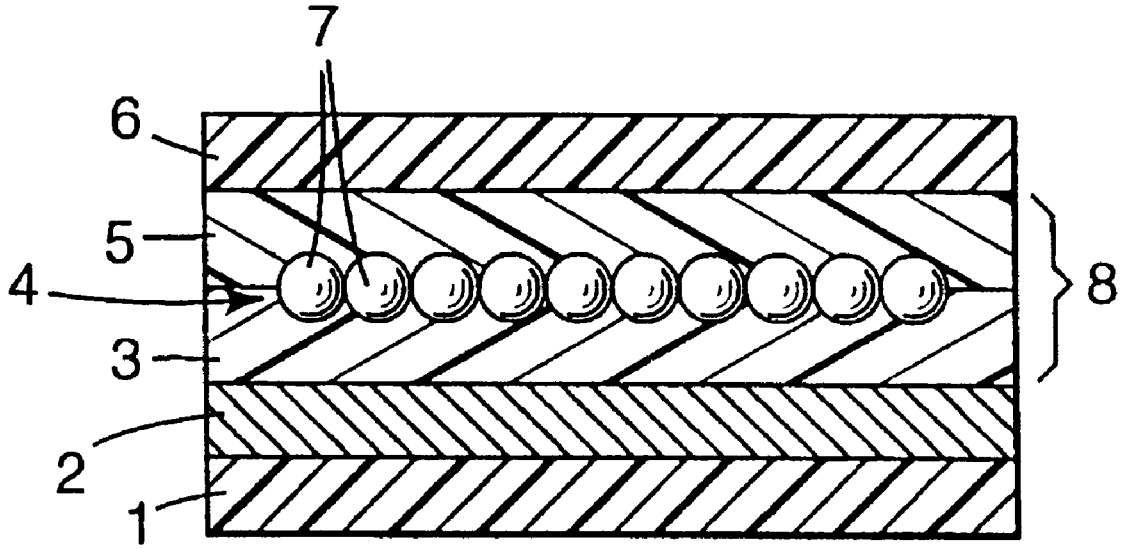
FIG. 1 is a cross-sectional view of one EL device of the present invention.

FIG. 1 shows a cross section of an example of the EL device according to the present invention having the following numerals and elements: 1: Transparent substrate, 2: transparent conductive layer, 3: support layer, 4: luminescent particle layer, 5: insulating layer, 6: rear 30 electrode, 7 luminescent particles, 8: luminescent layer.

EL Device

The EL device comprises a laminate having a transparent substrate (1) and a transparent conductive layer (2), a rear electrode (6) and a luminescent layer (8) placed between this laminate and the rear electrode (8). The structure of the EL device of this form is substantially the same as that of the conventional dispersion type EL device except the structure of the luminescent layer (8).

The luminescent layer (8), which will be explained in detail below, has a structure in which the transparent support layer (3) comprising the matrix resin, the insulating layer containing the insulating material, and the luminescent particle layer (4) placed between the layers (3) and (5), which are laminated in close contact.

In general, the thickness of the whole EL device is in the range between 50 and 3000 $\mu$m.

Transparent substrate

The transparent substrate may be the same as that used in the dispersion type EL devices, and for example, glass plates, plastic films and the like can be used. Examples of the plastic films are films of polyester resins such as polyethylene terephthalate (PET), polyethylene naphthalate (PEN), etc.; acrylic resins such as polymethyl methacrylate, modified polymethyl methacrylate, etc.; fluororesins such as polyvinylidene fluoride, acryl-modified polyvinylidene fluoride, etc.; polycarbonate resins; vinyl chloride resins such as vinyl chloride copolymers; and the like.

The transparent substrate may be a single layer film as shown in FIG. 1, while it may be a multilayer film. For example, whiteness of the light can increase, when at least one layer of the multilayer film has high transparency and contains a dye which develops a complimentary color to a color emitted by the luminescent layer. Preferably, examples of such the dye are red or pink fluorescent dyes such as rhodamine 6G, rhodamine B, perylene dyes, etc. when the emitted light from the luminescent layer is blue-green.

The both surfaces of the transparent substrate are usually flat, while the surface which is not in contact with the transparent conductive layer may have prismatic projections unless the effects of the present invention are impaired.

The light transmission through the transparent substrate is usually at least 60%, preferably at least 70%, in particular at least 80%. "Light transmission" means a transmission of light measured according to JAPANESE INDUSTRIAL STANDARD K 7105 using light of 550 nm.

The transparent substrate may contain additives such as UV light absorbers, moisture absorbents, colorants, fluorescent materials, phosphors, and the like unless the effects of the present invention are impaired.

Transparent conductive layer

The transparent conductive layer is placed on the back surface of the transparent substrate in close contact therewith.

The transparent conductive layer may be any transparent electrode which is used in the dispersion type EL devices such as an ITO (Indium-Tin Oxide) film, and the like. The thickness of the transparent conductive layer is usually between 0.1 and 1000 $\mu$m, the surface resistivity is usually between 1000 and 500 Ω/square, preferably between 200 and 300 Ω/square. The light transmission is usually at least 70%, preferably at least 80%.

The ITO film is formed by any conventional film-forming method such as vapor deposition, sputtering, paste coating, and the like.

The ITO film is formed directly on the transparent substrate in the embodiment of FIG. 1, while a primer layer may be formed on the transparent substrate, and then the ITO film may be formed on the primer layer. In place of the primer layer, the surface of the transparent substrate is treated with corona, and the like for facilitating the adhesion of the ITO film. Alternatively, the ITO film is formed on the luminescence layer and then the transparent substrate is laminated on the ITO film.

The rear electrode layer is placed on the back surface of the luminescent layer, that is, the side facing the insulating layer. The rear electrode is in direct contact with the luminescent layer in the embodiment of FIG. 1.

A resin layer can be provided between the rear electrode and the luminescent layer for increasing the adhesion between them. The resin for the resin layer may be a polymer with a high dielectric constant, which will be explained below. The resin layer may contain insulating organic particles.

The rear electrode may be a conductive film used in the dispersion type EL devices such as a metal film of aluminum, gold, silver, copper, nickel, chromium, etc.; a transparent conductive film such as an ITO film; and the like. The metal film may be a vapor deposited film, a sputtered film, a metal foil, and the like.

The thickness of the rear electrode is usually between 5 and 1000 $\mu$m.

The EL device can emit light from both surfaces when the rear electrode consists of the transparent conductive film and the insulating layer is transparent.

Support layer

The support layer for the luminescent layer is placed preferably on the back surface of the transparent conductive layer in close contact therewith, and thereby the luminescent efficiency of the luminescent layer is easily increased.

The support layer is a transparent layer containing a matrix resin. The thickness of the supped layer is usually between 5 and 1000 $\mu$m, and the light transmission is usually at least 70%, preferably at least 80%.

The matrix resin may be a resin which is used in the dispersion type EL devices such as epoxy resins, polymers having a high dielectric constant, and the like. The polymers having the high dielectric constant are those having a dielectric constant of usually at least about 5, preferably between 7 and 25, more preferably between 8 and 18, when it is measured by applying an alternating current of 1 kHz. When the dielectric constant is too low, the luminance may not increase. When it is too high, the life of the luminescent layer tends to shorten.

Examples of the polymers having the high dielectric constant are vinylidene fluoride resins, cyanoresins, and the like. For example, the vinylidene fluoride resin may be obtained by copolymerization of vinylidene fluoride and at least one other fluorine-containing monomer. Examples of the other fluorine-containing monomer are tetrafluoroethylene, trifluorochloroethylene, hexafluoropropylene, and the like. Examples of the cyanoresin are cyanoethylcellulose, cyanoethylated ethylene-vinyl alcohol copolymer, and the like.

The support layer consists of the matrix resin in the embodiment of FIG. 1, while it may contain additives such as other resins, fillers, surfactants, UV light absorbers, antioxidants, anti-fungus agents, rust-preventives, moisture absorbents, colorants, phosphors, and the like, unless the effects of the present invention are impaired. For example, the support layer may contain red or pink fluorescent dyes such as rhodamine 6G, rhodamine B, perylene dyes, and the like, when the emitted light from the luminescent particle layer is blue-green. Furthermore, the above other resins may be curable or tacky.

Insulating layer

The insulating material contained in the insulating layer of the luminescent layer may be insulating particles, polymer having a high dielectric constant, and the like, which are used in the dispersion type EL devices.

The insulating layer in the embodiment of FIG. 1 is a coating layer formed from a paint which has been prepared by dispersing the insulating particles in the polymer having the high dielectric constant. Examples of the insulating particles are insulating inorganic particles of, for example, titanium dioxide, barium titanate, and the like. The polymers having the high dielectric constant may be the polymers used for the support layer.

The insulating layer may be formed by coating the paint on either the rear electrode or the luminescent particle layer.

When the insulating layer is the coating layer comprising the insulating particles and the polymer having the high dielectric constant, the amount of the insulating particles is between 1 and 400 wt. parts, preferably between 10 and 300 wt. parts, more preferably between 20 and 200 wt. parts, per 100 wt. parts of the polymer having the high dielectric constant. When the amount of the insulating particles is too low, the insulating effect decreases, and thus the luminance tends to decrease. When the amount is too high, the application of the paint may be difficult.

The thickness of the insulating layer is usually between 5 and 1000 $\mu$m. The insulating layer may contain additives such as fillers, surfactants, antioxidants, antifungus agents, rust-preventives, moisture absorbents, colorants, phosphors, curable resins, tackifiers, and the like, insofar as the insulating properties are not impaired.

Luminescent particle layer

The luminescent particles in the luminescent particle layer spontaneously emit light when they are placed in an alternating electric field. As such the particles, fluorescent particles which are used in the dispersion type EL devices can be used. Examples of the fluorescent materials are single substances of fluorescent compounds (e.g. ZnS, CdZnS, ZnSSe, CdZnSe, etc.), or mixtures of the fluorescent compounds and auxiliary components (e.g. Cu, I, Cl, Al, Mn, $NdF_3$, Ag, B, etc.).

The average particle size of the fluorescent particles is usually between 5 and 100 $\mu$m. The particulate fluorescent materials on which a coating film of glass, ceramics, and the like is formed may be used.

The thickness of the luminescent particle layer is usually between 5 and 500 $\mu$m. When the fluorescent particle layer consists of a plurality of particles which are placed in a single layer state, the EL device can be made thin easily.

Furthermore, the luminescent particle layer may contain at least two kinds of luminescent particles. For example, at least two kinds of luminescent particles which emit blue, blue-green or orange light and have discrete spectra each other are mixed, and thus a luminescent layer having the high whiteness can be formed.

The content of the luminescent particles in the luminescent particle layer is preferably at least 40 wt. %. When the content is less than 40 wt. %, the effects for improving the luminance may decrease. The luminance can be maximized when the particles consist of the luminescent particles. Accordingly, the particularly preferable content of the luminescent particles is between 50 and 100 wt. %.

The luminescent particle layer may contain one or more kinds of particles other than the luminescent particles, for example, particles of glass, coloring materials, phosphors, polymers, inorganic oxides, and the like. For example, luminescent particles which emit blue-green light and a pink-coloring material which is the complimentary color to blue-green (e.g. particles containing rhodamine 6G, rhodamine B, etc.) are mixed for forming the luminescent layer having the high whiteness.

Formation of luminescent layer

The laminate structure of the luminescent layer comprising the support layer, luminescent particle layer and insulating layer may be formed as follows:

Firstly, the luminescent particle layer is formed on the surface of either the support layer or the insulating layer by any conventional powder coating method.

For example, particles containing the luminescent particles are scattered on the substrate layer while it maintains flowability, by a suitable method such as static suction, spraying, gravimetric scattering, and the like, and the luminescent particle layer in which a part or whole of the particles are embedded in the support layer is formed. After that, the flowability of the support layer is suppressed, and the support layer and the particle layer are bonded. For maintaining the flowability of the support layer, following methods are preferable: A method for maintaining the undried state of the coating layer formed from the paint for the support layer containing the solvent, A method for maintaining the support layer at a temperature higher than the softening or melting point of the resin for the support layer, and A method for adding a radiation-curable monomer to the paint for the support layer. These methods make a solidifying procedure for suppressing the flowability of the support layer (drying, cooling or hardening) easy.

In the same way, the luminescent layer can be formed on the insulating layer made of the coating layer.

The final layer (either the support layer or the insulating layer) is laminated on the luminescent particle layer which has been formed as above, and the laminate structure in which the three layers are bonded is formed. The final layer is preferably laminated by coating a paint containing materials for forming the final layer and solidifying it, or by press-bonding a film made of materials for forming the final layer. These methods can surely form a bonded structure without the presence of any bubble at the interface between each pair of the support layer, luminescent particle layer and insulating layer.

The luminescent particle layer consists of a plurality of particles which are placed in a single layer state and is bonded to both the support and insulating layers, in the embodiment of FIG. 1. However, the luminescent particle layer may be a multilayer, or a part or whole of the particles may be embedded entirely in either the support layer or the insulating layer. It is important to form a bonded structure in which the luminescent particle layer is placed between the support layer and the insulating layer, and no bubbles are present at the interface between each pair of the layers.

In the luminescent particle layer formed as above, the materials of the support or insulating layer penetrate in spaces between the particles. In such the case, a filling rate of the particles is usually at least 20 vol. %, preferably at least 30 vol. %, more preferably at least 40 vol. %, since the decrease of the filling rate may lead to the decrease of luminance.

Herein, the "filling rate of particles" is defined as a percentage of the total volume of the particles in the volume of a hypothetical layer comprising all the particles in the luminescent particle layer and the materials which are present between the particles.

Furthermore, each of the support and insulating layers may be a laminate of two or more layers, unless the effects of the present invention are impaired.

Production of EL device

Now, the production method of the present invention, which is suitable for the production of the above described EL device, will be explained.

Firstly, the transparent substrate, on which surface the transparent conductive layer has been laminated, is provided. A paint for forming the support layer is applied on the transparent conductive layer. After that, particles containing the luminescent particles are scattered in a layer state over the applied paint prior to drying of the paint, and the particle layer is partly embedded in the support layer, followed by drying of the paint. These steps can easily form the luminescent particle layer which is partially embedded in and bonded to the support layer.

The particles are embedded in the support layer so that usually 1 to 99%, preferably 10 to 90%, more preferably 20 to 80% of the size of each particle in the vertical direction (to the plane of the support layer) is embedded in the support layer. When the embedded percentage is less than 1%, the particle layer tends to be damaged during the formation of the insulating layer. When the particles are embedded so that the embedded percentage exceeds 99 the particle layer may not be formed uniformly.

The coating thickness of the paint for forming the support layer is selected so that the dry thickness of the support layer is in the above range. The solid content in the paint for forming the support layer is usually between 5 and 80 wt. %. A solvent used in the paint is selected from conventional organic solvents so that the matrix resin is homogeneously dissolved.

The paint may be prepared with mixing or kneading apparatuses such as homomixers, sand mills, planetary mixers, and the like.

For applying the paint, coating apparatuses such as bar coaters, roll coaters, knife coaters, die coaters, and the like can be used.

The drying conditions depend on the kind of solvent in the paint and the solid content of the paint, and usually include a temperature in the range between room temperature (about 25° C.) and 150° C., and a drying time in the range between 5 seconds and 1 hour.

The particles are scattered by the above method within one minute from the application of the paint for forming the support layer, which makes the embedding of particles easy. The drying degree of the paint depends on the wettability between the particles and the support layer, and is usually in the range between 10 and 95 wt. %, preferably between 20 and 90 wt. % in terms of the solid content.

Subsequently, the paint for forming the insulating layer is applied so that the luminescent particle layer is covered, and dried. Accordingly, a bonded structure, in which the luminescent particle layer is embedded in both the support and insulating layers and no bubble is present at the interface between each pair of the layers, is formed.

The coating thickness of the paint for forming the insulating layer is selected so that the dry thickness of the insulating layer is in the above range.

The solid content in the paint for forming the insulating layer is usually between 5 and 70 wt. %. A solvent used in the paint is selected from conventional organic solvents so that the insulating material is homogeneously dissolved or dispersed.

This paint may be prepared and applied using the same apparatuses or tools as those used for preparing and applying the paint for forming the support layer.

The drying conditions depend on the kind of solvent in the paint and the solid content of the paint, and usually include a temperature in the range between room temperature (about 25° C.) and 150° C., and a drying time in the range between 5 seconds and I hour.

Finally, the rear electrode is laminated on the insulating layer. The rear electrode may be formed by the above described methods. Among them, the methods for forming thin films in vacuum such as the vapor deposition and sputtering are preferable for effectively forming the rear electrode on the insulating layer, which has been dried after drying, with good adhesion between the rear electrode and the insulating layer.

The steps of the above described production method are substantially the same as those of a conventional method for producing a sheet-form product. Therefore, the sheet-form EL devices having a high luminance and a large area can be produced at high productivity using the production steps for the conventional sheet-form products. Furthermore, the problems caused by the use of dispersion paints are solved, since the above method does not use the dispersion paints of the luminescent particles unlike the production of the dispersion type EL devices.

The EL devices may be produced by an alternative method which may analogous to the above method, comprising applying the paint for the insulating layer on the support including the rear electrode, scattering the luminescent particles prior to drying of the applied paint, embedding a part of the particle layer in the insulating layer, then, drying the paint for the insulating layer, applying and drying the paint for the support layer, and finally laminating the transparent substrate which carries the transparent conductive layer. This method has the same effects as the above described method.

Application of EL device

The EL device of the present invention can be used as a back-light source for liquid crystal displays such as liquid crystal instrument panels of automobiles. In addition, the EL device of the present invention can be used as a light source for internal-illuminating type displays such as billboards, road signs, decorative displays, and the like.

For example, images such as characters, designs, and the like are printed on the surface of a light-transmitting sheet, and the sheet is placed on the EL device with the back surface of the sheet facing the light-emitting side of the EL device. The light-transmitting sheet may be made of the same material as that of the above transparent substrate, and has a light transmission of at least 20%. In this case, the back surface of the sheet and the light-emitting side of the EL device are preferably bonded each other. To this end, a light-transmitting adhesive is used. Examples of such the adhesive are pressure-sensitive acrylic adhesives, heat-sensitive acrylic adhesives, and the like.

Alternatively, an EL device built-in type display can be assembled by using the light-transmitting sheet as the above transparent substrate, forming the transparent conductive layer directly on the back surface of the light-transmitting sheet, and laminating the luminescent layer on the conductive layer.

Furthermore, a prism type retroreflective sheet may be used as the light-transmitting sheet (or the transparent substrate). The combination with the retroreflective sheet can impart both the retroreflectivity and the self-light-emitting properties to the EL device built-in type display.

Light is emitted from the EL device by connecting two terminals, which are in connection with the transparent conductive layer and the rear electrode layer, respectively, to a power source, and applying a voltage to the EL device.

As the power source, cells such as dry cells, batteries, solar cells, etc. may be used, or an alternating current is supplied to the EL device from a power line through an invertor, which alters the voltage or frequency, or change the current between the alternating current and the direct current. The applied voltage is usually between 3 and 200 V.

The EL device of the present invention has the high light-emitting efficiency, and therefore emit light with sufficient luminance (for example, 50 cd/m$^2$ or higher) at a lower voltage (for example, 100 V or lower) than that necessary for the conventional dispersion type ones.

When the EL device is used outdoors, it is preferably covered with water-capturing films made of, for example, polyamide resins, or moistureproof films made of, for example, polytetrafluoroethylene.

EXAMPLE 1

Production of EL device

An ITO/PET laminate film (trade name: TCF-KPC 300-75 (A) manufactured by OIKE Industries, Ltd.) (thickness, 75 $\mu$m; light transmission, 81%) was used as a transparent substrate having an ITO layer. This film had a transparent conductive layer of ITO which had been laminated by sputtering on one surface of the film. The ITO layer has a thickness of 550 nm and a surface resistivity of 250 12/square.

Separately, a paint for forming a support layer was prepared by mixing and uniformly dissolving a polymer having a high dielectric constant (a tetrafluoroethylene-hexafluoropropylene-vinylidene fluoride copolymer; trade name "THV 200 P" having a dielectric constant of 8 (at 1 kHz) and a light transmission of 96%) in ethyl acetate with a homomixer. The solid content of the paint was about 25 wt. %.

The paint for forming the support layer was applied on the transparent conductive layer which was laminated on the transparent substrate. Luminescent particles were scattered over the applied paint in substantially the single layer state prior to drying of the paint, and embedded in the paint so that about 50% of the diameter sunk. After that, the paint was dried. The paint was applied with a notched bar at a barset of 50 $\mu$m, and the particles were scattered immediately after the application of the paint. The drying conditions included a temperature of about 65° C. and a drying time of about one minute. The luminescent particles were ZnS luminescent particles (trade name: S-728 manufactured by OSRAM SYLVANIA; average particle size, about 23 $\mu$m).

Next, a paint for forming an insulating layer was applied so that the paint covered the luminescent particle layer and dried, and an insulating layer was formed. Thereby, a bonded structure, in which the luminescent particle layer was embedded both in the support and insulating layers and substantially no bubbles were present at interfaces between each pair of layers, was formed.

The paint for forming the insulating layer was prepared in the same manner as that for the paint for forming the support layer except that a polymer having a high dielectric constant (THV 200 P described above), insulating particles (barium titanate manufactured by KANTO KAGAKU) and ethyl acetate were mixed. The weight ratio of the polymer to the insulating particles was 100:80, and the solid content of the paint was about 38 wt. %. The paint was applied with a notched bar at a barset of 100 $\mu$m, and the drying conditions included a temperature of about 65° C. and a drying time of about one minute.

Finally, a rear electrode layer made of aluminum was laminated on the insulating layer by vacuum deposition, and a film-form EL device of the present invention was obtained. In this step, the vacuum deposition was carried out using a vacuum deposition apparatus "EBV-6DA" (manufactured by ULVAC) under reduced pressure of $10^{-5}$ Torr or less for 5 seconds.

Light emission from EL device

Respective terminals were attached to the transparent conductive layer and the rear electrode layer of the EL device of this Example (prepared by cutting the above sheet-from device in a square of 100 mm×100 mm), and were joined to a power source (PCR 500L manufactured by KIKUSUI ELECTRONIC INDUSTRIES, Ltd.). Then, the alternating voltage was applied to the device under two sets of conditions (condition A: 100 V, 400 Hz; condition B: 120 V, 600 Hz). The EL device emitted light uniformly under the both conditions.

The EL device was placed in a dark room, and the luminance was measured at a distance of 1 meter from the surface of the transparent substrate using a luminance meter (LS 110 manufactured by MINOLTA). The results are shown in Table 1.

Comparative Example 1

An EL device was produced in the same manner as in Example 1 except that a "dispersion type" luminescent layer was used.

The "dispersion type" luminescent layer was formed as follows:

The same polymer having the high dielectric constant as used in Example 1 (100 wt. parts), fluorescent particles (150 wt. parts) and ethyl acetate were mixed and dispersed with a homomixer, and a paint for forming a luminescent layer was obtained. The solid content of the paint was about 45 wt. %. The paint was applied on the transparent conductive layer of the transparent substrate using a notched bar at a barset of 80 Km, and dried at about 65° C. for about one minute.

The luminance of the EL device of this Example was measured in the same manner as in Example 1. The results are shown in Table 1.

EXAMPLE 2

An EL device was produced in the same manner as in Example 1 except that ZnS fluorescent particles (S-723 manufactured by OSRAM SYLVANIA) was used as fluorescent particles. The luminance of the EL device of this Example was measured in the same manner as in Example 1. The results are shown in Table 1.

EXAMPLE 3

An EL device was produced in the same manner as in Example 1 except that a cyanoresin (CR-M 723 manufactured by SHINETSU CHEMICAL) was used as a polymer having a high dielectric constant for the support and insulating layers. The luminance of the EL device of this Example was measured in the same manner as in Example 1. The results are shown in Table 1.

TABLE 1

| | Polymer having high dielectric constant | Fluorescent particles | Luminance (cd/m$^2$) Condition A | Condition B |
|---|---|---|---|---|
| Example 1 | THV 200P | S-728 | 52.2 | 105.7 |
| Example 2 | THV 200P | X-723 | 58.9 | 98.8 |
| Example 3 | CR-M | S-728 | 85.3 | 146.7 |
| C. Ex. 1 | THV 200P | S-728 | 26.0 | 44-4 |

Effects of the invention

The present invention can easily increase the filling rate of the luminescent particles in the luminescent layer, and provide the EL devices having the luminance which is at least about 2 times larger than that of the dispersion type EL device.

The present invention can produce the sheet-form EL devices having a large area and a high luminance at a high productivity without using any dispersion paint for forming a luminescent layer. According to the present invention, the sheet-form EL devices having the large area can be mass-produced by supplying a rolled transparent substrate sheet having a width of 25 to 200 cm and a length of 100 to 20,000 m and successively laminating tie transparent conductive layer, support layer, luminescent particle layer, insulating layer and rear electrode.

What is claimed is:

1. An electroluminescent device comprising:

a) a transparent substrate, b) a transparent conductive layer placed on the back surface of said transparent substrate, c) a luminescent layer comprising luminescent particles and a matrix resin and being placed on the back surface of said transparent conductive layer, and d) a rear electrode placed on the back surface of said luminescent layer, wherein said luminescent layer comprises:

(c-1) a transparent support layer comprising a matrix resin and being placed on the side of said transparent conductive layer, (c-2) an insulating layer comprising an insulating material and being placed on the side of said rear electrode, wherein the insulating material includes insulating particles and a polymer having a high dielectric constant, and (c-3) a luminescent particle layer consisting essentially of particles which comprise luminescent particles and are embedded in both said support layer and said insulating layer.

2. The electroluminescent device of claim 1, wherein the insulating particles comprise between 1 to 400 parts per 100 parts of the polymer.

3. The electroluminescent device of claim 2, wherein the insulating particles comprise between 10 to 300 parts per 100 parts of the polymer.

4. The electroluminescent device of claim 3, wherein the insulating particles comprise between 20 to 200 parts per 100 parts of the polymer.

5. The electroluminescent device of claim 5, wherein the luminescent particle layer includes at least two kinds of luminescent particles.

6. The electroluminescent device of claim 5, wherein the luminescent particle layer includes luminescent particles which emit blue-green light and luminescent particles which emit a color which is complimentary to blue-green light.

7. An electroluminescent device comprising:

a transparent support layer;

an insulating layer comprising an insulating material, wherein the insulating material includes insulating particles and a polymer having a high dielectric constant; and a luminescent particle layer consisting essentially of particles which comprise luminescent particles and are embedded in both the support layer and the insulating layer.

8. The electroluminescent device of claim 7, the electroluminescent device further comprising:

a transparent substrate;

a transparent conductive layer positioned between the transparent substrate and the transparent support layer; and a rear electrode positioned adjacent the insulating layer.

9. The electroluminescent device of claim 7, wherein the insulating particles comprise between 1 to 400 parts per 100 parts of the polymer.

10. The electroluminescent device of claim 9, wherein the insulating particles comprise between 10 to 300 parts per 100 parts of the polymer.

11. The electroluminescent device of claim 10, wherein the insulating particles comprise between 20 to 300 parts per 200 parts of the polymer.

12. The electroluminescent device of claim 7, wherein the luminescent particle layer includes at least two kinds of luminescent particles.

13. The electroluminescent device of claim 12, wherein the luminescent particle layer includes luminescent particles which emit blue-green light and luminescent particles which emit a color which is complimentary to blue-green light.

14. An electroluminescent device comprising:

a transparent support layer;

an insulating layer comprising an insulating material, wherein the insulating layer includes insulating particles and a polymer having a high dielectric constant, and wherein the insulating particles comprising between 20 and 200 parts per 100 parts of the polymer; and a luminescent particle layer consisting essentially of particles which comprise luminescent particles and are embedded in both the support layer and the insulating layer, wherein the luminescent particle layer includes at least two kinds of luminescent particles.

15. The electroluminescent device of claim 14, wherein the luminescent particle layer includes luminescent particles which emit blue-green light and luminescent particles which emit a color which is complimentary to blue-green light.

16. The electroluminescent device of claim 14, the electroluminescent device further comprising:

a transparent substrate;

a transparent conductive layer positioned between the transparent substrate and the transparent support layer; and a rear electrode positioned adjacent the insulating layer.

* * * * *

UNITED STATES PATENT AND TRADEMARK OFFICE

CERTIFICATE OF CORRECTION

PATENT NO. : 6,406,803 B1
DATED : June 18, 2002
INVENTOR(S) : Abe, Hidetoshi

It is certified that error appears in the above-identified patent and that said Letters Patent is hereby corrected as shown below:

Column 4,
Line 45, delete "supped" and insert in place thereof -- support --.

Column 6,
Line 36, insert -- . -- following "solvent".
Line 38, delete "A" and insert in place thereof -- a --.

Signed and Sealed this

Eighteenth Day of March, 2003

JAMES E. ROGAN
*Director of the United States Patent and Trademark Office*